US007168107B2

(12) United States Patent
Gruenwald

(10) Patent No.: US 7,168,107 B2
(45) **Date of Patent: *Jan. 30, 2007**

(54) SPA APPARATUS

(75) Inventor: David J. Gruenwald, Butte Des Morts, WI (US)

(73) Assignee: European Touch Holdings, Inc., Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/108,509

(22) Filed: Apr. 18, 2005

(65) Prior Publication Data

US 2005/0183198 A1 Aug. 25, 2005

Related U.S. Application Data

(63) Continuation of application No. 10/385,916, filed on Mar. 11, 2003, now Pat. No. 6,880,182.

(60) Provisional application No. 60/436,128, filed on Dec. 23, 2002.

(51) Int. Cl.
*A47K 3/10* (2006.01)

(52) U.S. Cl. ..... 4/541.1

(58) Field of Classification Search ..... 4/619, 4/621, 622, 541.1–541.5, 643; 601/160, 601/166

See application file for complete search history.

(56) References Cited

U.S. PATENT DOCUMENTS

| | | | | |
|---|---|---|---|---|
| 4,903,352 | A * | 2/1990 | Murakami | 4/541.3 |
| 5,729,841 | A * | 3/1998 | Chan | 4/622 |
| 6,363,548 | B1 * | 4/2002 | Kuo | 4/622 |
| 6,438,768 | B1 * | 8/2002 | Yen | 4/622 |
| 6,880,182 | B2 * | 4/2005 | Gruenwald | 4/541.1 |

* cited by examiner

*Primary Examiner*—Huyen Le
(74) *Attorney, Agent, or Firm*—Foley & Lardner LLP

(57) ABSTRACT

A spa apparatus and method for cleaning the same are disclosed. The spa apparatus includes a basin for retaining fluid, a removable foot rest plate positioned within the basin, an impeller coupled to the basin, and a motor drivably coupled to the impeller.

15 Claims, 10 Drawing Sheets

SPA APPARATUS

CROSS REFERENCE TO RELATED APPLICATIONS

This is a continuation of application Ser. No. 10/385,916 filed on Mar. 11, 2003 now U.S. Pat. No. 6,880,182. The present application claims priority to U.S. patent application Ser. No. 10/385,916 filed Mar. 11, 2003 and granted as U.S. Pat. No. 6,880,182 entitled "Spa Apparatus" by Gruenwald which claims priority to U.S. Provisional Application 60/436,128 filed Dec. 23, 2002, entitled "Spa Apparatus" by Gruenwald both of which are incorporated herein by reference.

FIELD OF THE INVENTION

The present invention relates to a spa device. In particular, the present invention relates to a spa apparatus for use in activities related to a foot massage.

BACKGROUND OF THE INVENTION

It is generally known to provide for a spa device, such as health spas, whirlpools, jet stream exercisers, foot spas, etc. Such known spa devices are typically used in commercial and recreational settings for hydrotherapy, massage, stimulation, pedicure, and bathing purposes. However, such spa devices have several disadvantages including being difficult to thoroughly clean, requiring complicated maintenance schedules, and often providing harsh and uncomfortable massages.

Water quality can become a problem in systems that use circulating water that comes into contact with the human body where the spa is not thoroughly cleaned. Several actions have been taken in an attempt to overcome this difficulty, including the addition of chemicals (e.g., bleach) into the water to help control bacteria growth. Despite such efforts, however, water quality is sometimes still difficult to maintain. For example, bacteria can develop simple defense mechanisms to counter chemical attacks such as forming a protective outer coating that acts as a barrier against harsh chemical treatments. The destruction of the outer coating is generally difficult with chemicals alone. Often times, chemicals are only effective in destroying the outer coating when used for extended periods of time, sometimes hours. Therefore, the preferred method of eliminating bacteria from systems is through mechanical means such as abrasion (e.g., removal with a rag and a chemical cleanser that has anti-bacterial capabilities).

Furthermore, many spa devices have intricate and elaborate systems of pipes that move water from a pump, through a filtering system, and ultimately to one or more nozzles (e.g., openings) that deliver water back to a basin for re-circulation. In the case of a pedicure basin, the process of cleaning after each pedicure involves draining the water from the system, spraying the basin with some type of anti-bacterial cleanser, circulating the water for a period of time, rinsing and then refilling with fresh water. Because there are pipes and fittings, it is often difficult to mechanically scrub every component that comes into contact with water. In addition, after a system is drained, some water may remain within the piping system, usually in cracks and crevices or low spots in the pumping system. For example, the pump itself is usually a sealed unit that may be difficult to completely drain. It is within these areas that the bacteria tend to grow the outer coating as a defensive mechanism against attack from anti-bacterial chemicals, especially when the pedicure system is not used for extended periods (e.g., overnight, weekends, etc.). Consequently, water quality may be diminished in conventional piped systems that are not effectively cleaned.

Another problem with known spa devices is that they often provide a harsh massaging effect to the feet by pointing a small number of nozzles (e.g., openings) toward the top of the feet. These nozzles are generally connected via pipes and hoses to a single centrifugal pump that produces a very high pressure (20–40 psi) and a relatively low volume of water. Customers often complain that the jets of water produced in this manner are too rough, in some cases even producing pain or discomfort. Although the jets can be partially closed to reduce the force of the water stream, this also reduces the water volume. Consequently, the massage effect is minimized since the jets are often a considerable distance away from the feet (e.g., in the walls of the basin).

An example of an existing system is disclosed in U.S. Pat. No. 2,312,524 issued to William B. Cox. Specifically, Cox discloses a foot bathing device that utilizes foot rests consisting of a disk of heavy wire screening or a perforated plate (see col. 1, lines 43–44). This type of system can have several disadvantages including producing unrestricted streams of water. For example, Cox discloses the use of a flat foot rest containing a uniform pattern of openings across the entire foot rest that is not capable of directing the water in any particular direction (e.g., a foot rest that includes a uniform grid pattern across the entire foot rest).

Other problems with spa devices is the low position of the basin, that requires a technician to bend over while the technician works on a customers foot.

Further

Accordingly, it would be advantageous to provide a spa apparatus that substantially avoids the problems of bacterial growth by eliminating the need for pipes and/or pumps. Further, it would be advantageous to provide a spa apparatus with a removable foot rest plate for easy access to clean the basin and exposed components. It would also be advantageous to provide a spa apparatus that produces an improved massage of the foot by directing a flow of water at a much lower pressure while still maintaining a higher volume of water to specific areas of the foot. In addition, it would be advantageous to provide a spa apparatus that substantially eliminates the water fountain effect (e.g., excess splashing) sometimes found in other pedicure systems. It would be desirable to provide for a spa apparatus having one or more of these or other advantageous features.

SUMMARY OF THE INVENTION

A feature of the present invention is to provide a spa apparatus that overcomes the above-noted disadvantages.

Another feature of the present invention is to provide a spa apparatus that does not require circulation pipes or pumps, thereby reducing the bacteria problem within the apparatus.

Another feature of the present invention is to provide a spa apparatus with a removable foot rest plate that allows for easy access to clean the spa components exposed to water.

Another feature of the present invention is to provide a spa apparatus that does not require tools to install and/or remove the foot plate and/or screen.

Another feature of the present invention is to provide a spa apparatus that minimizes the water fountain effect.

Another feature of the present invention is to provide a spa apparatus that includes a safety mechanism that stops the impeller from rotating when the screen or foot rest plate is removed.

A still further feature is to provide a spa apparatus with a removable foot rest plate that sealingly engages the bottom of a basin to form a high pressure zone between the foot rest plate and the bottom of the basin.

How these and other advantages and features of the present invention are accomplished (individually, collectively, or in various subcombinations) will be described in the following detailed description of the preferred and other exemplary embodiments, taken in conjunction with the FIGURES.

One embodiment of the invention provides a spa apparatus that includes a basin for retaining fluid. Further, the spa apparatus includes a foot rest plate removably positioned within the basin, the foot rest plate including a plurality of openings and at least one area without openings. The spa apparatus also includes an impeller coupled to the basin and a motor drivably coupled to the impeller.

Another embodiment of the invention provides a spa apparatus including a basin for retaining fluid. Further, the spa apparatus includes a foot rest plate removably positioned within the basin, the foot rest plate including a plurality of openings and at least one non-horizontal region. The spa apparatus also includes an impeller coupled to the basin and a motor drivably coupled to the impeller.

Another embodiment of the invention a basin for retaining fluid having a floor. A foot plate is operatively sealed to the basin. A first region is defined by an area between the foot plate and the floor of the basin. The foot plate includes an intake opening and at least one output opening. An impeller is located between a top surface of the plate and the floor of the basin and configured to draw fluid through the intake opening into the first region and to force the water out of the first region through the output opening.

In another embodiment, a water spa includes a basin configured to hold water. A removable foot rest plate having an upper surface is operatively secured to the basin below the free surface of the water. The foot rest plate includes an inlet opening and at least one output opening. A pump is configured to draw water through the inlet opening into a region below the foot rest plate and to distribute the water to the output opening under a pressure greater than the fluid pressure of the water above the foot rest plate.

Another embodiment of the invention provides a method of cleaning a spa apparatus including removing a foot rest plate from the spa apparatus. In addition, the method includes mechanically cleaning the spa apparatus with a cleanser, including each component exposed to fluid during use of the spa apparatus. Further, the method includes replacing the foot rest plate in the spa apparatus.

The present invention further relates to various features and combinations of features shown and described in the disclosed embodiments. Other ways in which the objects and features of the disclosed embodiments are accomplished will be described in the following specification or will become apparent to those skilled in the art after they have read this specification.

Figure 1:
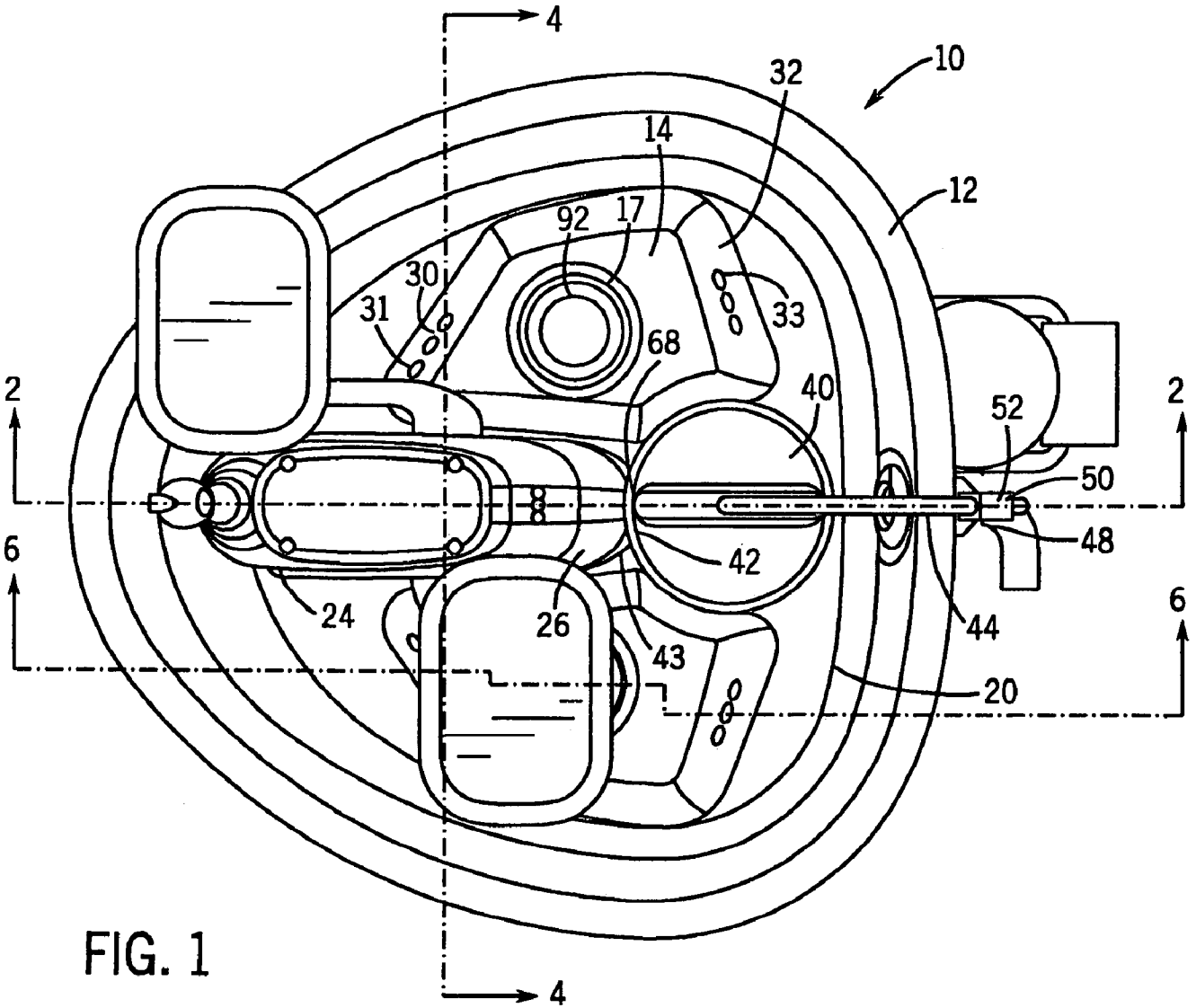
FIG. 1 is a top plan view of the spa apparatus according to an exemplary embodiment.

Before describing a number of preferred, exemplary, and alternative embodiments of the invention in detail, it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, while the components of the disclosed embodiments will be illustrated as a spa apparatus designed for feet or foot spas, the features of the disclosed embodiments have a much wider applicability. For example, the spa design is adaptable for other spa devices including spas for hands, other body parts, entire bodies, etc. Further, the size of the various components and the size of the apparatus can be widely varied.

Second, the particular materials used to construct the exemplary embodiments are also illustrative. For example, the basin of the spa apparatus may be made from a scratch resistant material such as borosilicate or other suitable material. Further, components of the spa apparatus can be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, etc. Also, other molding operations may be used to form these components, such as blow molding, rotational molding, etc. In addition, various components of the spa apparatus can be manufactured from stamped alloy materials such as steel or aluminum.

Proceeding now to descriptions of the preferred and exemplary embodiments, FIGS. 1–7 show spa apparatus 10 according to a preferred embodiment. Spa apparatus 10 is configured for use in foot massages, pedicures, and other activities related to the feet, including bathing, soaking, stimulating, etc.

Spa apparatus 10 includes a basin 12 configured to retain fluid (e.g., water) for use with various cleaning and/or massage activities. Spa apparatus 10 also includes a foot rest plate 14 positioned within the basin, an impeller 16 coupled to basin 12, and a motor 18 located external to the basin for rotating impeller 16 so that fluid is directed through foot rest plate 14.

Figure 3:
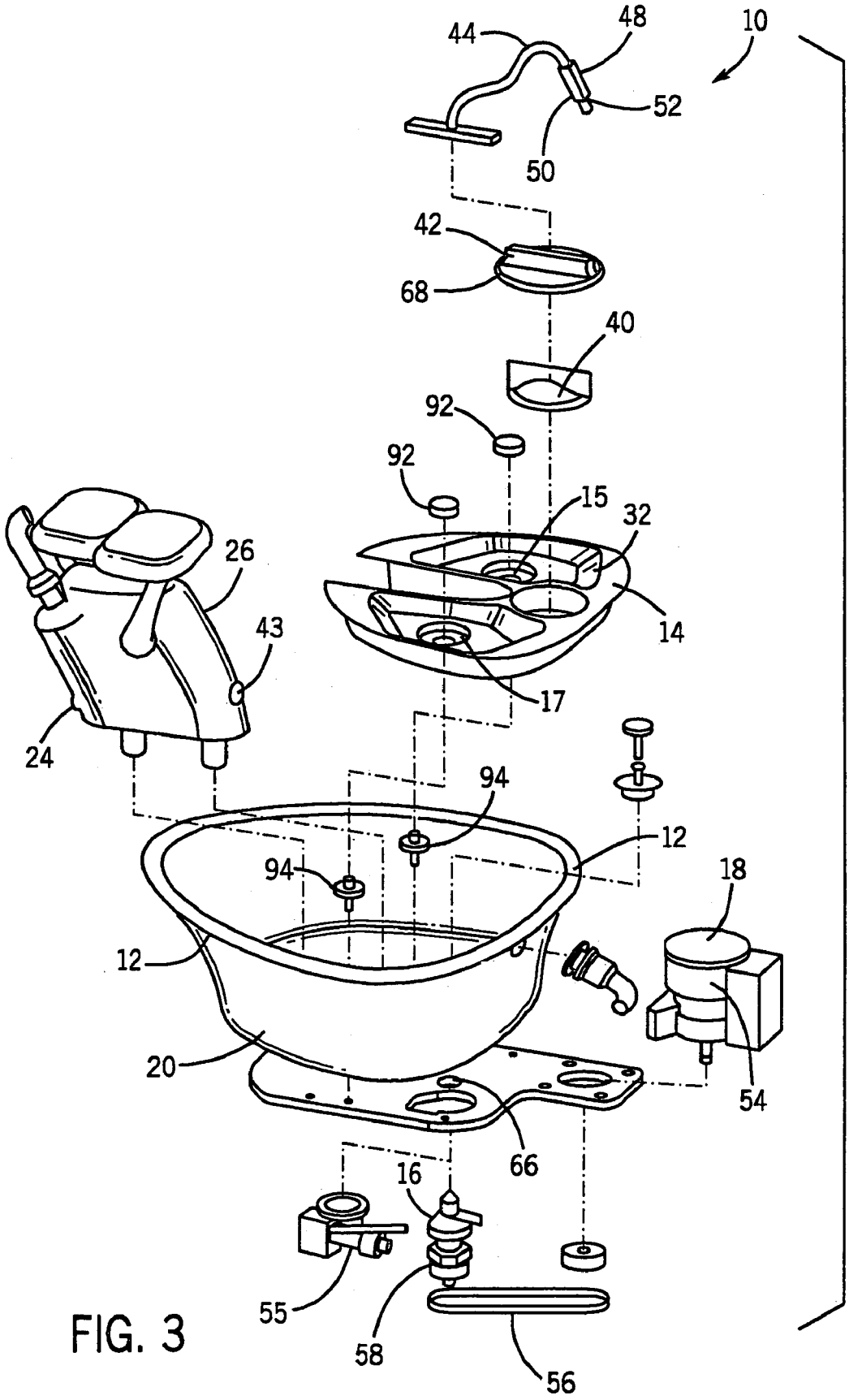
FIG. 3 is an exploded perspective view of the spa apparatus according to an exemplary embodiment.
Figure 4:
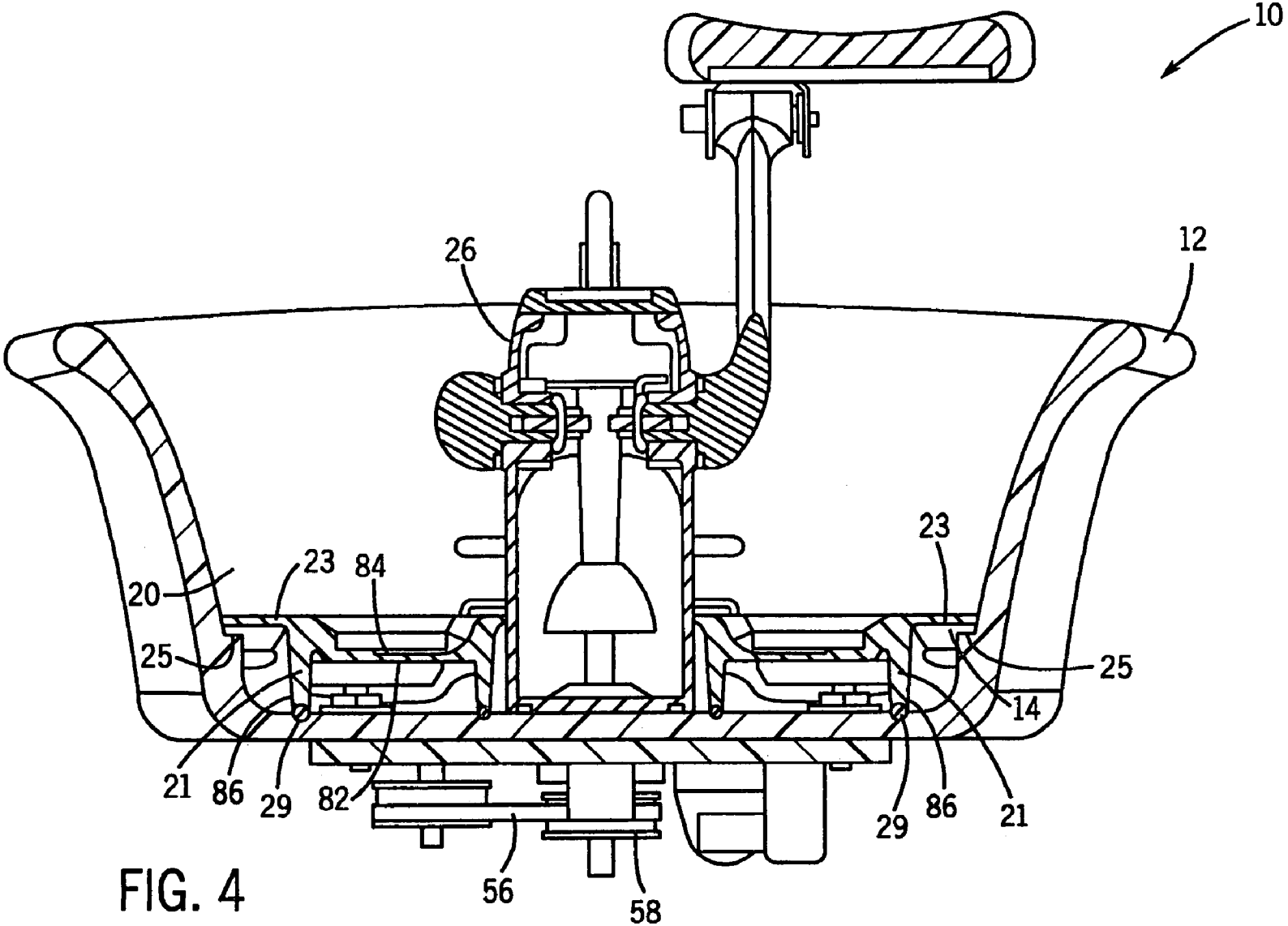
FIG. 4 is a sectional view of the spa apparatus taken along line 4—4 of FIG. 1.
Figure 5:
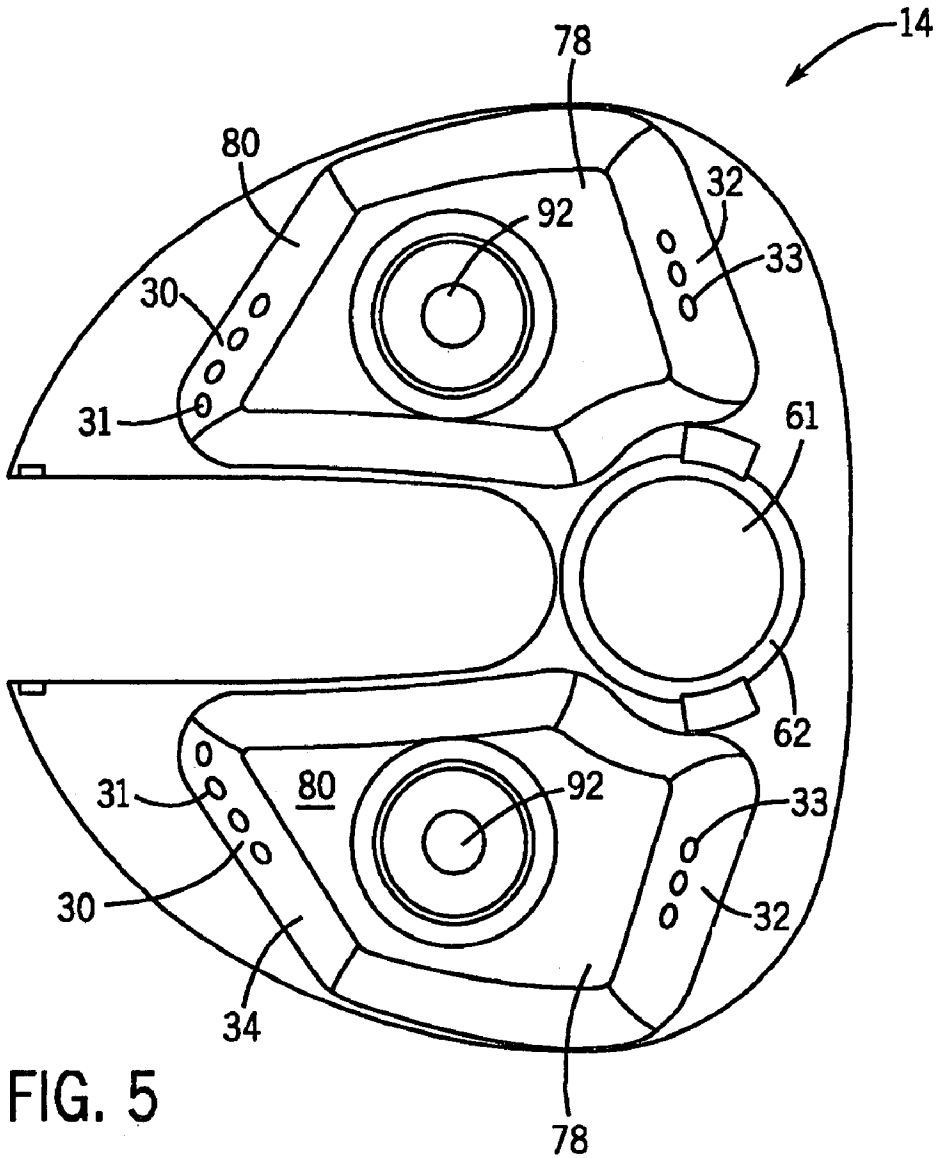
FIG. 5 is a top plan view of a foot rest plate according to an exemplary embodiment.
Figure 6:
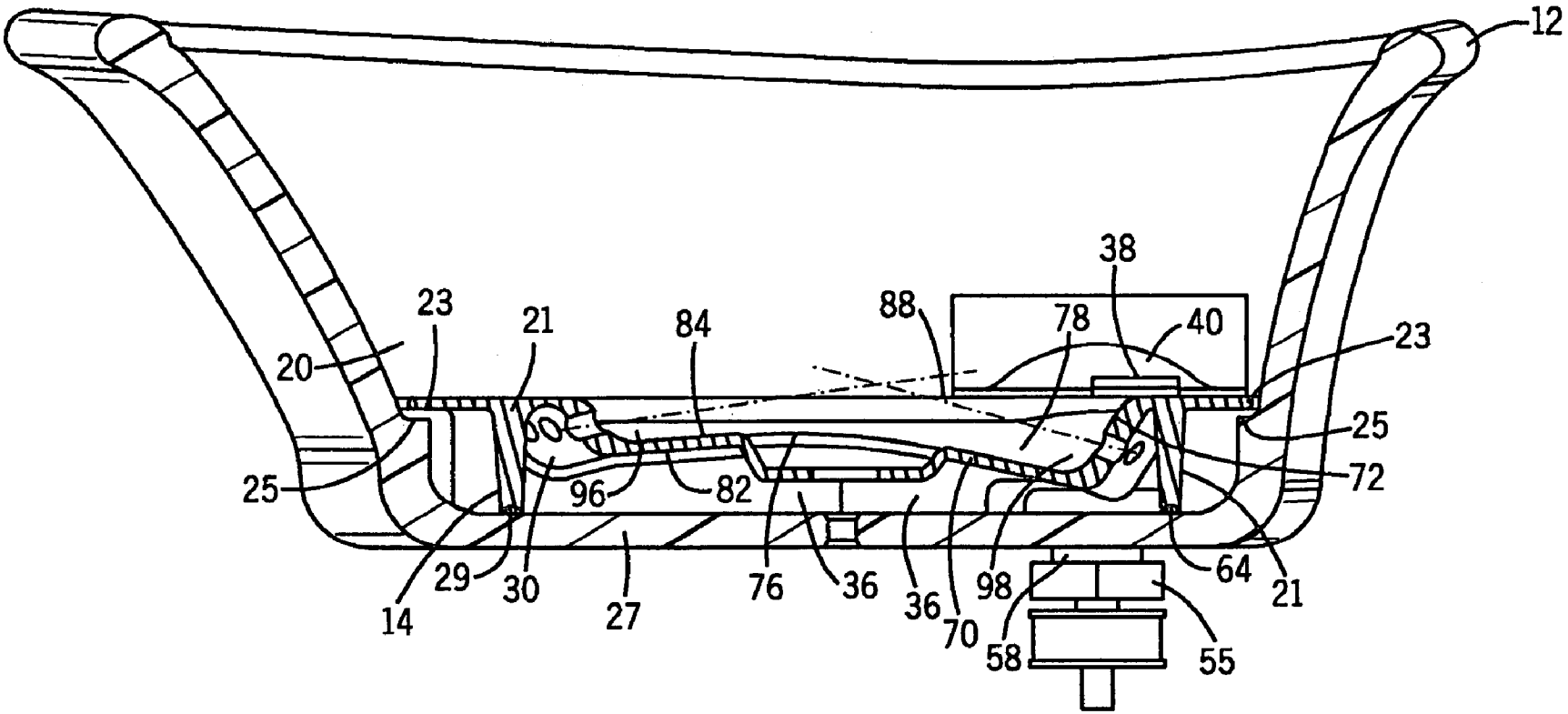
FIG. 6 is a sectional view of a foot rest plate taken along line 6—6 of FIG. 1.
Figure 7:
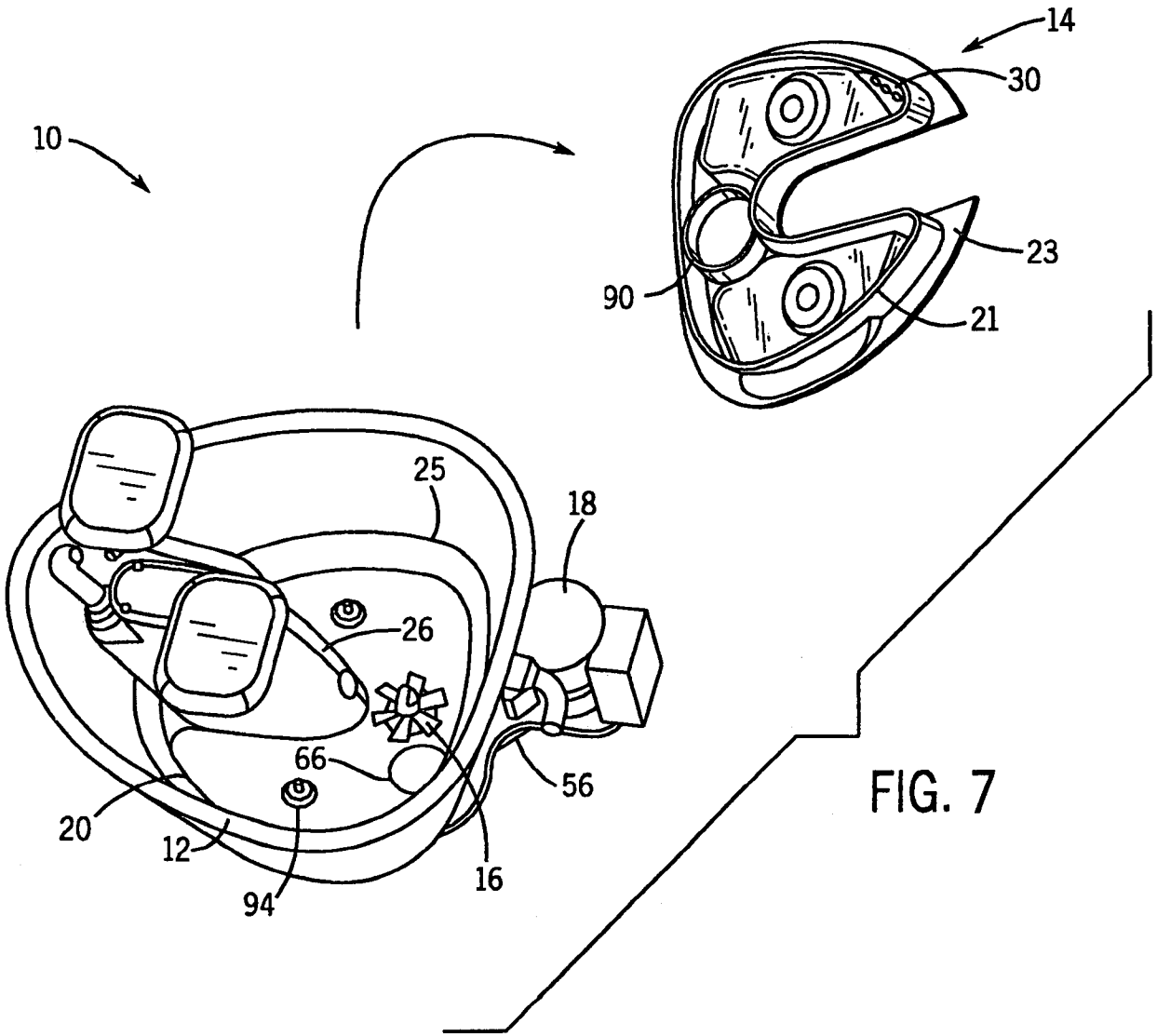
FIG. 7 is an exploded perspective view of the spa apparatus configured so that it may be cleaned according to an exemplary embodiment.
Figure 11:
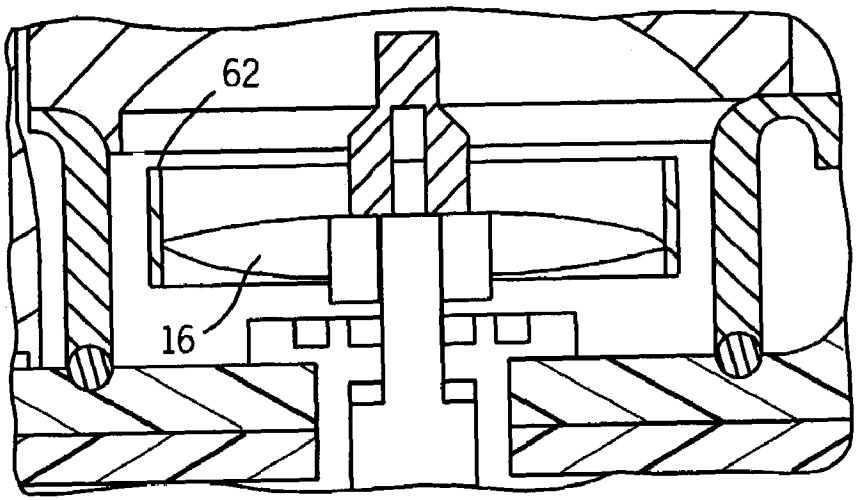
FIG. 11 is a cross-sectional view of a duct coupled to the free end of the impeller.
Figure 8:
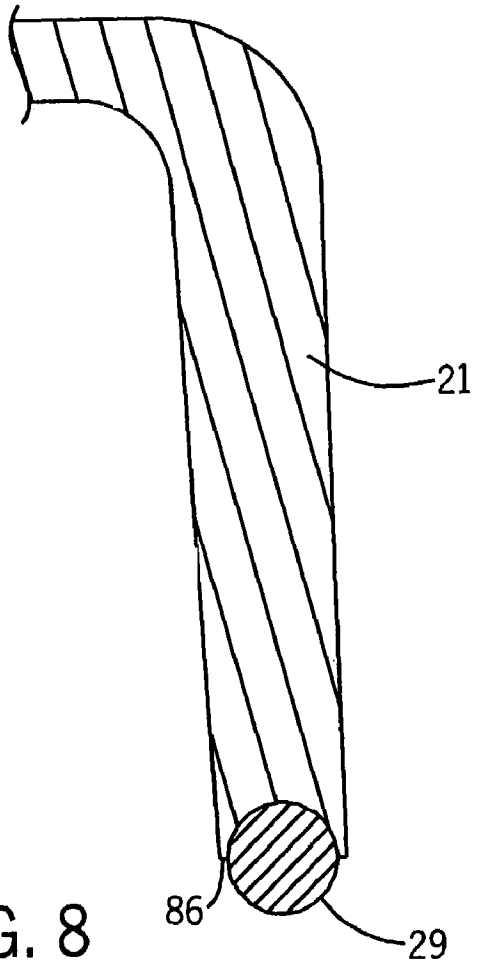
FIG. 8 is a partial sectional view of a foot rest plate taken generally along line 8—8 of FIG. 6.
Figure 9:
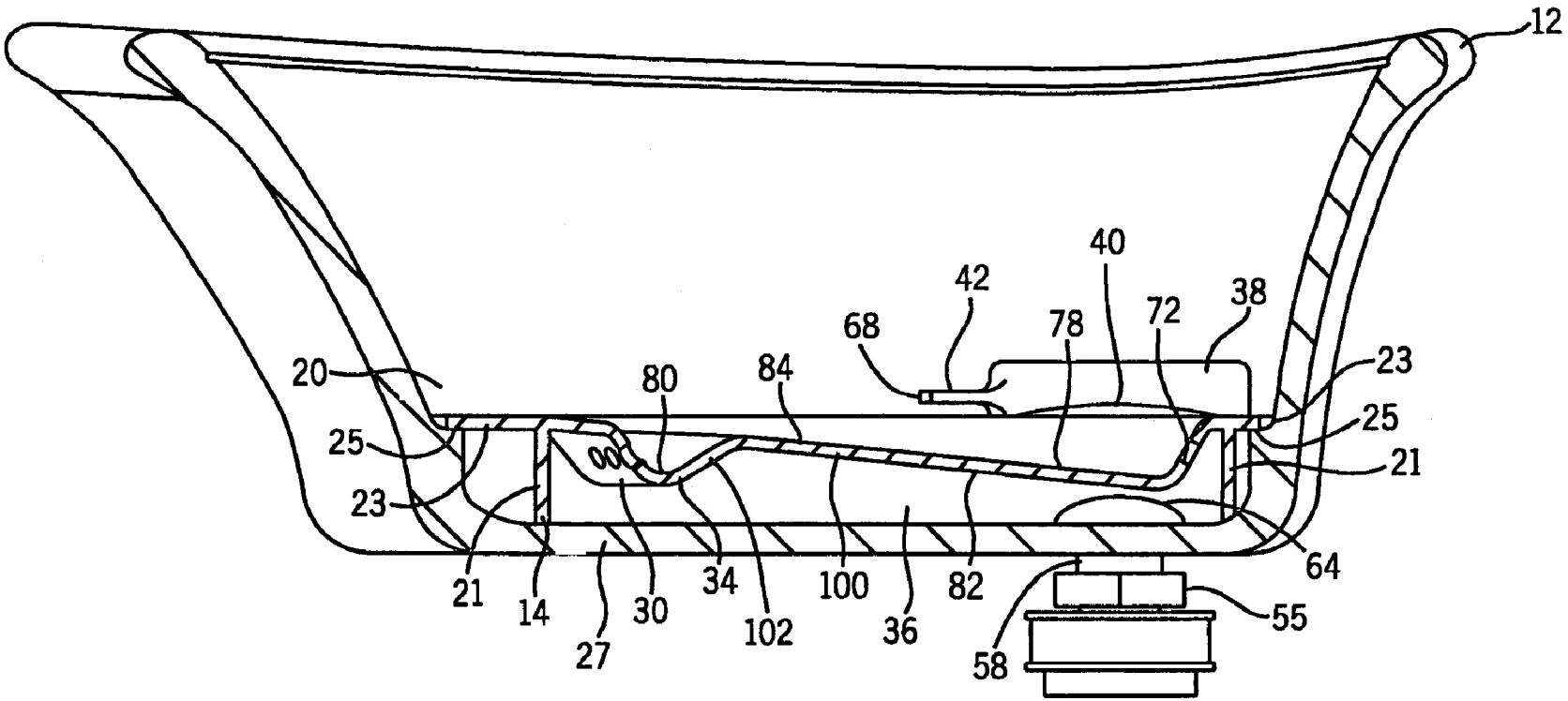
FIG. 9 is a sectional view of a foot rest plate according to an alternative embodiment.

Foot rest plate 14 is preferably positioned in the lower portion 20 of basin 12. According to an exemplary embodiment, foot rest plate 14 is removably coupled to basin 12 below the fluid surface, and in the preferred embodiment rests on the floor of basin 12. Foot rest plate 14 forms a seal with the floor or bottom surface 27 of basin 12 to restrict the flow of fluid around foot rest plate 14. Referring to FIGS. 6–8, foot rest plate 14 includes a lower ridge 21 having a neoprene sealing ring 29 located in a groove 86 to form a seal when foot rest plate 14 makes contact with basin 12. The seal may be formed between lower ridge 21 and bottom surface 27 of basin 12 and/or between upper ridge 23 and ledge 25 of basin 12. In a preferred embodiment, foot rest plate 14 is held in position within basin 12 by caps 92. As shown in FIG. 3, caps 92 are removably coupled to fasteners 94 which are fixedly attached to basin 12. Fasteners 94 are positioned in basin 12 to protrude through apertures 15 on foot rest plate 14 when foot rest plate 14 is positioned within basin 12. Foot rest plate 14 includes fastener cavities 17 where fasteners 94 and caps 92 may be coupled together without interfering with operation of apparatus 10. Caps 92 are coupled to fasteners 94 by threading caps 92 onto fasteners 94 until a desired seal is obtained. Caps 92 are coupled to fasteners 94 with sufficient force to secure foot rest plate 14 within basin 12 to prevent any leaking within apparatus 10 during operation of the system. Alternatively, caps 92 may be coupled to fasteners 94 by a variety of other methods such as, for example, clamping, screwing, hooking, clipping, snapping, etc. Caps 92 form seals with foot rest plate 14 after being coupled to fasteners 94. Similarly, fasteners 94 form seals with basin 12. According to an alternative embodiment as shown in FIG. 9, foot rest plate 14 may be held in position within basin 12 by a protrusion 24 on the side of a center console 26 that is positioned within basin 12. Alternatively, foot rest plate 14 may be held in position within basin 12 by various fastening or joining methods (e.g., fastening, clamping, hooking, sliding, etc.). According to a preferred embodiment, foot rest plate 14 is configured so that a user may easily remove plate 14 without tools. This allows a user easy access to mechanically clean (e.g., scrub with a cleanser such as water, soap, detergent, disinfectant, antiseptic, etc.) the components of spa apparatus 10 that are exposed to water.

In the particular embodiment illustrated, foot rest plate 14 includes a first nozzle system 30 and a second nozzle system 32. Nozzle system 30 is positioned on foot rest plate 14 to direct a stream of fluid in a non-vertical direction. Nozzle system 30 includes at least a first opening 31 configured to direct fluid in a non-vertical direction. More specifically, opening 31 is configured to direct a stream of fluid at the front of the foot, including the toes. Nozzle system 32 is positioned on foot rest plate 14 to direct a stream of fluid in a non-vertical direction. Nozzle system 32 includes at least a second opening 33 configured to direct fluid in a non-vertical direction. More specifically, opening 33 is configured to direct a stream of fluid at the back of the foot, including the heel. As used in this application, the vertical direction is a generally upward direction parallel to the vertical plane. Further, the vertical plane is perpendicular to the horizontal plane or the plane of resting fluid within the basin.

Foot rest plate 14 is configured so that users are able to move their feet to adjust the location of nozzle systems 30 and 32 relative to their feet. In effect, this allows users to control how the water exiting nozzle systems 30 and 32 makes contact with their feet. As shown in FIG. 6, foot rest plate 14 has an overall configuration that approximates the general shape and/or curvature of the human foot. First opening 31 of nozzle system 30 may be positioned at an angle 96 of about 0 to 30 degrees with respect to the horizontal plane. According to a preferred embodiment, water exits first opening 31 at an angle 96 of about 8 degrees with respect to the horizontal plane. Additionally, second opening 33 may be positioned such that water may exit at an angle 98 of about 0 to 40 degrees. According to a preferred embodiment, water exits second opening 33 at an angle 98 of about 15 degrees with respect to the horizontal plane. Further, by placing the first opening 31 and the second opening 33 at the described angles and having the two streams of fluid collide near the center of the basin, the water fountain effect can be greatly diminished. For example, when openings 31 and 33 are positioned directly opposite one another so that the fluid streams intersect and have a canceling effect on each other, the resultant fluid stream vector has a minimized vertical component. Consequently, splashing from the spa apparatus is greatly diminished. Alternatively, openings 31 and 33 may be positioned so that the resultant fluid flows do not directly intersect. For example, openings 31 and 33 may be positioned so that the fluid exiting openings 31 and 33 are parallel to one another. This may be accomplished by offsetting openings 31 and 33 so they do not lie directly opposite one another, directing openings 31 and 33 to produce parallel flows, etc.

Further, openings 31 and 33 are arranged in a non-uniform pattern on foot rest plate 14. As used in this application, the term "uniform" means consistent throughout an entire area. For example, screens and grids are often characterized by uniform perforations or openings over the entire surface of the screen or grid. Each opening or perforation is generally uniform in shape and distribution throughout the object. Since foot rest plate 14 has a non-uniform pattern of openings, plate 14 includes at least one area without any perforation or openings. In other words, foot rest plate 14 does not have an even and continuous distribution of openings across its entire surface.

Foot rest plate 14 serves several purposes. For example, foot rest plate 14 provides support for the foot at a desired angle for comfort. In addition, foot rest plate 14 protects the foot from contact with the rotating impeller housed beneath it. Further, foot rest plate 14 confines, constricts, and directs the flow of water from impeller 16 to nozzle systems 30 and 32 formed in the foot rest plate. Furthermore, foot rest plate 14 also serves to divide basin 12 into a high pressure zone 36 and a low pressure zone 38. The high pressure zone 36 is located between basin 12 and the bottom of foot rest plate 14 whereas low pressure zone 38 is located above the top of foot rest plate 14. Consequently, the cavity formed between basin 12 and foot rest plate 14 (e.g., high pressure zone 36) takes the place of, and in effect replaces the pipes in a conventional pipe system.

Figure 2:
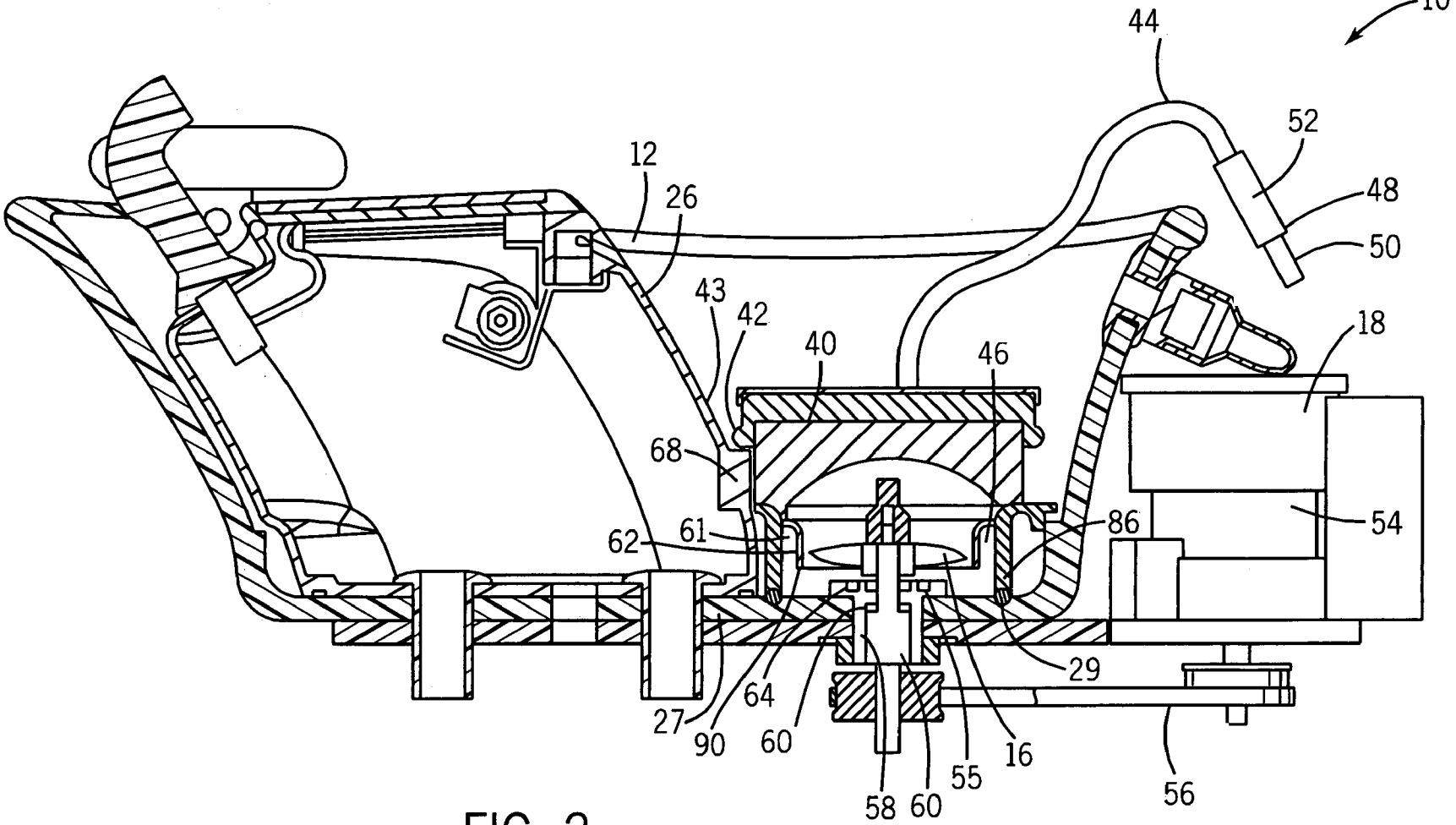
FIG. 2 is a sectional view of the spa apparatus taken along line 2—2 of FIG. 1.

A screen 40 is configured to be positioned over the opening of inlet or intake 61 of foot rest plate 14 and is coupled to console 26 and/or foot rest plate 14. Referring to FIG. 2, tab 42 on screen 40 abuts edge 43 on console 26. Alternatively, screen 40 may be coupled to foot rest plate 14 and/or console 26 by various fastening or joining methods (e.g., fastening, clamping, hooking, sliding, etc.). Alternatively, screen 40 may be integrally formed as part of a single unitary body with foot rest plate 14 and/or console 26. Moreover, in alternative embodiments, screen 40 may be omitted or replaced by one or more openings.

In one embodiment foot spa apparatus 10 may include an air line 44 coupled to screen 40 to control the outflow of air mixed in the fluid streams through nozzle systems 30 and 32. According to an exemplary embodiment, air line 44 may comprise a hose or standpipe. According to alternative embodiments, air line 44 may comprise other devices (e.g., cylinders, pipettes, pipes, lines, inlets, channels, etc.). Air line 44 is generally positioned to bring air to the low pressure side 46 of impeller 16 and to mix air into the fluid stream. In addition, air line 44 may include a valve 48 to regulate the amount of air in the fluid stream. In the particular embodiment illustrated, valve 48 is controlled by an air line switch 50 located on a handset 52. Alternatively, valve 48 may be controlled by other electronic or mechanical devices (e.g., button, knob, etc.). Moreover, in alternative embodiments, air line 44 and/or valve 48 may be omitted.

According to an exemplary embodiment, spa apparatus 10 includes a motor 18. Motor 18 may be enclosed in a motor housing 54 and coupled to belt 56 so that when motor 18 operates, belt 56 rotates in a cyclical manner. Belt 56 may also be coupled to a shaft 58 which is supported by bearings 60 and secured within a shaft housing 55. Shaft 58 is further coupled to impeller 16 so that the cyclical rotation of belt 56 also rotates impeller 16. Consequently, the rotation of impeller 16 causes the fluid to be drawn in through screen 40 and out through nozzle systems 30 and 32.

Referring to FIG. 3, spa apparatus 10 may include a circular duct 62 that can either be coupled to impeller 16 or to foot rest plate 14 proximate the opening of inlet or intake 61. The circular duct acts to confine the water flow around impeller 16. Circular duct 62 may extend from the opening of inlet 61 and extend downward surrounding impeller 16. Circular duct 62 includes a lower edge 90 that is located a predetermined distance above the floor 27 to allow water being drawn into inlet 61 to be guided downward through the duct 62 into zone 36 and out of openings 31 and 33. It is possible to couple the circular duct 62 directly to the ends of the impeller blades, such that the duct 62 rotates with the impeller 16. In this embodiment, the duct should be located as close as possible to the opening of inlet 61 and to the circumference of the opening.

A duct seal 64 coupled to basin 12 and shaft housing 55 also keeps the fluid in basin 12 from escaping out of the apparatus. Spa apparatus 10 may also include a drain 66 for releasing at least some of the fluid from basin 12. Drain 66 is located on the lower portion 20 of basin 12.

A sensor switch 68 is located within apparatus 10 senses when foot rest plate 14 is in position. In addition, sensor switch 68 senses when screen 40 is in position. Upon sensing that either screen 40 or foot rest plate 14 are out of position, sensor switch 68 shuts off power to motor 18 to prevent the operation of motor 18. Sensor switch 68, therefore, acts as a safety mechanism to reduce the risk of accidental injury caused by the operation of impeller 16.

Referring to FIGS. 3 and 6, foot rest plate 14 is configured so that a foot may rest at an angle relative to the horizontal plane within spa apparatus 10. Referring to FIG. 6, foot rest plate 14 includes radiused surface 70 that supports the foot during operation of apparatus 10. According to a preferred embodiment, radiused surface 70 has a radius of about 20 inches. Further, radiused surface 70 is about 10 inches in length. Of course the length of radiused surface 70 could be longer or shorter to accommodate variations in size of most feet. Foot rest plate 14 may also include backing 72 to further support a user's heel. Backing 72 may be configured at an angle for added comfort. According to a preferred embodiment, backing 72 is configured at an angle of about 15 degrees with respect to the horizontal plane. Further, backing 72 is about 3 inches in length.

Radius 76 enables a user to position their toes within the stream of water exiting opening 31 according to the user's desired configuration. For example, depending on the position of a user's foot, the stream of water may flow against the toes, over the foot, under the foot, around the foot, etc. The location and angle of the foot determines how the stream of water flows relative to the foot. Radius 76 extends from radiused surface 70 to create toe region 80. According to a preferred embodiment, heel region 78 is positioned lower than toe region 80 so that a user may angle their foot upward from heel to toes.

The operation of spa apparatus 10 will now be described. According to a preferred embodiment, foot rest plate 14 is positioned within basin 12 prior to use such that neoprene sealing ring 29 comes into contact with the floor 27 of basin 12. As a result zone 36 is formed between the underside 82 of foot rest plate 14, the lower ridges 21, and the floor 27 of basin 12. Fluid is placed in basin 12 up to a desired level above the upper surface 84 of foot rest 14. Prior to operation of motor 18, water will fill zone 36 by entering through openings 31 and 33 and through intake 61. Operation of motor 18 causes impeller 16 to rotate and consequently draw fluid from basin 12 through screen 40 and inlet 61 through circular duct 62 and into zone 36. The rotation of impeller 16 creates a low pressure zone 38 above foot rest plate 14 and a high pressure zone 36 below foot rest plate 14. This difference in pressure causes the fluid to move from basin 12 down through circular duct 62 and eventually out through openings 31 and 33. Further, the shape and angles of foot rest plate 14 guide the exiting fluid from opening 31 against, under, over, and around the front of a user's foot positioned within spa apparatus 10. Similarly, the shape and angles of foot rest plate 14 guide the exiting fluid from opening 33 against the back of the heel and around the foot.

In one embodiment, the pressure differential between the high pressure zone 36 and low pressure zone 38 is approximately two psi. Of course the pressure differential may be greater than or less than two psi and may be adjusted. However, pressure substantially above two psi results in a flow that is turbulent and may also result in an uncomfortable effect on a user's feet. In one embodiment, water is circulated at 60 gpm with approximately 4.3 gpm through each of openings 31, 33. Of course other pressure differentials and flow rates may be selected by increasing the speed of the impeller or the size and/or number of openings 31, 33.

As described above in a preferred embodiment, water exits opening 31 at an angle of about 8 degrees with respect to the horizontal plane. This angle allows the water to be directed over the top of a user's foot if the user's foot is moved back toward opening 33 at the heel region. By moving one's foot away from the heel region and toward nozzle system 31, the water from opening 31 may be directed under the toes or heel of one's foot. This allows the user to determine where the water exiting the opening 31 should be directed. The recessed location of opening 31 due to the curvature and/or shape of foot rest plate 14 makes it difficult for a user to block the openings thereby disrupting the balance of the water flow. Additionally it is believed that being too close to the opening does not produce a pleasant affect. The location of opening 31 and the shape of foot rest plate 14 help ensure that a user's foot will not entirely come into contact with the openings during operation of the system. Water exits opening 33 an angle of about 15 degrees relative to the horizontal plane. Referring to FIG. 6, the stream of water exiting opening 31 forms an included angle 88 of 23 degrees with the stream of water exiting from opening 33.

Referring to FIG. 9, in an alternative embodiment, foot rest plate 14 may include recessed cavity 34 where nozzle system 30 is located. Recessed cavity 34 allows nozzle system 30 to direct a stream of fluid in a non-vertical direction and makes it difficult for a user to block the openings thereby disrupting the balance of the water flow. In addition, foot rest plate may include incline surface 100 and slope 102. Incline surface 100 and slope 102 help support the foot during operation of apparatus 10.

During cleaning of spa apparatus 10, foot rest plate 14 may be easily and conveniently removed from basin 12 without the use of tools. Referring to FIG. 7, drain 66 may be opened before foot rest plate 14 is removed so that fluid flows out of basin 12. Caps 92 may then be removed from fasteners 94. Similarly, screen 40 may then be removed by moving tab 42 so that it no longer abuts edge 43 on console 26. After removing caps 92 and/or screen 40, foot rest plate 14 may be lifted out of position from within basin 12. After foot rest plate 14 has been removed, spa apparatus 10 may be mechanically scrubbed and cleaned. The ability to remove foot rest plate 14 enables a user to quickly and efficiently clean each piece of apparatus 10 that comes into contact with fluid during operation, including impeller 16, basin 12, console 26, foot rest plate 14, etc. After cleaning apparatus 10, basin 12 and the other components may be rinsed out. Once apparatus 10 is cleaned, foot rest plate 14 may easily be re-positioned back within basin 12. After foot rest plate 14 has been positioned within basin 12, caps 92 may be coupled to fasteners 94 to retain foot rest plate 14 in position. Similarly, screen 40 may be positioned over inlet 61 of foot rest plate 14 and coupled to console 26 and/or foot rest plate 14. Apparatus 10 may be cleaned as needed to maintain the desired water quality.

Figure 10:
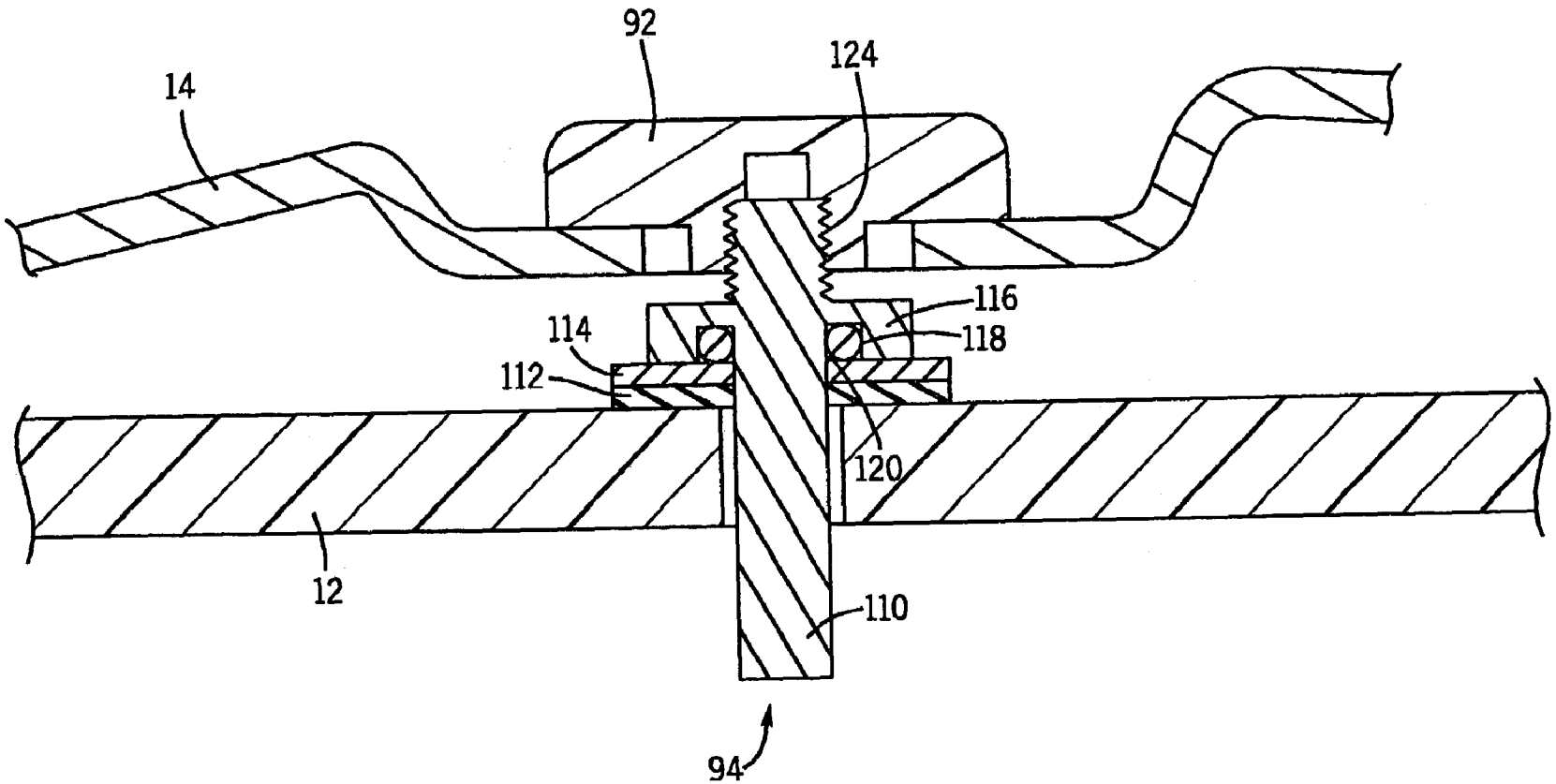
FIG. 10 is a cross-sectional view of the fastener for the foot rest plate of FIG. 6.

Referring to FIG. 10, fastener 94 includes stud 110 which extends through basin 12. Stud 110 includes a shoulder portion 116 which has a circular groove 120. Circular groove 120 houses an O-ring 118 to act as a seal to prevent water from flowing between stud 110 and basin 12. Further, stud 110 and shoulder portion 116 are positioned to couple with steel washer 114 which couples with rubber washer 112. Rubber washer 112 couples with basin 12 and forms a seal to prevent Water from leaking out of apparatus 10 during operation of the system. In addition, fasteners 94 include threaded portions 124. Stud 110 includes male threads whereas rubber cap 92 includes female threads. Rubber cap 92 may therefore be threaded onto the threaded portion 124 of fastener 94 to a desired tension. As rubber cap 92 is threaded onto fastener 94, a seal is formed between rubber cap 92 and foot rest 14. This seal prevents water from leaking between underside 82 and upper surface 84 of foot rest 14. Once cap 92 is attached to fastener 110, foot rest plate 14 may be retained in position so that foot rest 14 is not dislodged by the water pressure created during operation of apparatus 10.

It is also important to note that the construction and arrangement of the elements of the spa apparatus as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the basin of the spa apparatus may be made from borosilicate or other suitable material. Further, other components of the spa apparatus may be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, steel, aluminum, alloys, etc. Also, other fabricating, stamping, or molding operations may be used to form these components. Accordingly, all such modifications are intended to be included within the scope of the present invention as defined in this application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention.

What is claimed is:

1. A spa apparatus comprising:

a basin for retaining fluid;

a foot rest plate removably positioned within the basin, the foot rest plate including a plurality of openings and at least one area without openings;

an impeller coupled to the basin; and a motor drivably coupled to the impeller;

wherein the foot rest plate comprises at least a first nozzle system configured to direct fluid in a non-vertical direction and non-horizontal direction, the first nozzle system including at least a first opening;

wherein the foot rest plate further comprises a second nozzle system configured to direct fluid in a non-vertical direction, the second nozzle system including at least a second opening;

wherein the first nozzle system is configured to direct fluid toward the second nozzle system and the second nozzle system is configured to direct fluid toward the first nozzle system.

2. A spa apparatus comprising:

a basin for retaining fluid;

a foot rest plate removably positioned within the basin, the foot rest plate including a plurality of openings and at least one area without openings;

an impeller positioned in the basin; and a motor drivably coupled to the impeller;

the foot rest plate including a first nozzle system and a second nozzle system, the impeller directing the fluid through the first nozzle system toward the second nozzle system;

the first nozzle system being configured to direct fluid in a non-vertical direction and a non-horizontal direction, the first nozzle system including at least a first opening, the second nozzle system being configured to direct fluid in a non-vertical direction, the second nozzle system including at least a second opening; and wherein the fluid directed toward the second nozzle system and the fluid directed toward the first nozzle system form an included angle between 0 and 45 degrees.

3. A spa comprising:

a basin for retaining fluid having a floor;

a foot plate operatively sealed to the basin below an upper edge of the basin;

a first region defined by an area between the foot plate and the floor of the basin, the plate having an intake opening and at least one output opening;

an impeller having at least one blade member having a free end, the blade member being located between a top surface of the plate and the floor of the basin, a duct completely surrounding the impeller proximate the free end of the blade member, the impeller configured to draw fluid through the intake opening into the first region and to force the fluid out of the first region through the duct and the output opening.

4. The spa of claim 3, wherein the fluid pressure in the first region is greater than the fluid pressure in a second region above the foot plate.

5. The spa of claim 4, wherein the duct extends from the foot rest plate.

6. The spa of claim 5, wherein the duct extends from the inlet.

7. A spa comprising:

a basin for retaining fluid having a floor;

a foot plate operatively sealed to the basin;

a first region defined by an area between the foot plate and the floor of the basin, the plate having an intake opening and at least one output opening;

an impeller having at least one blade member having a free end, the blade member being located between a top surface of the plate and the floor of the basin, a duct surrounding the impeller proximate the free end of the blade member, the impeller configured to draw fluid through the intake opening into the first region and to force the fluid out of the first region through the duct and the output opening; the fluid pressure in the first region being greater than the fluid pressure in a second region above the foot plate; and wherein the duct is coupled to the free end of the impeller.

8. The spa of claim 7, wherein the duct rotates with the impeller.

9. A spa apparatus comprising:

a basin for retaining fluid;

a foot rest plate removably positioned within the basin, the foot rest plate including a plurality of openings and an inlet, the foot plate operatively sealed to the basin below an upper edge of the basin;

an impeller drawing the fluid from above the foot rest plate through the inlet and a circular duct to a region between the foot rest plate and the basin creating a pressure in the region higher than the pressure above the foot rest plate, the impeller forcing the fluid through the plurality of openings; and a motor driving the impeller.

10. The spa apparatus of claim 9, wherein the foot rest plate includes a first sealing surface that sealing engages with a second sealing surface in the basin.

11. The spa apparatus of claim 10, wherein the impeller includes an at least one impeller blade, the impeller blade being surrounded by a duct.

12. The spa apparatus of claim 11, wherein the duct is located proximate the inlet.

13. A spa apparatus comprising:

a basin for retaining fluid;

a foot rest plate removably positioned within the basin, the foot rest plate including a plurality of openings and an inlet;

an impeller drawing the fluid from above the foot rest plate through the inlet to a region between the foot rest plate and the basin creating a pressure in the region higher than the pressure above the foot rest plate, the impeller forcing the fluid through the plurality of openings; and a motor driving the impeller, the foot rest plate including a first sealing surface that sealing engages with a second sealing surface in the basin; and further including a seal member located between the first and second sealing surfaces.

14. A spa apparatus comprising:

a basin for retaining fluid;

a foot rest plate removably positioned within the basin, the foot rest plate including a plurality of openings and an inlet;

an impeller drawing the fluid from above the foot rest plate through the inlet to a region between the foot rest plate and the basin creating a pressure in the region higher than the pressure above the foot rest plate, the impeller forcing the fluid through the plurality of openings; and a motor driving the impeller;

wherein the foot rest plate includes a first sealing surface that sealing engages with a second sealing surface in the basin;

wherein the impeller includes at least one impeller blade, the impeller blade being surrounded by a duct;

wherein the duct is located proximate the inlet; and wherein the duct is completely about the circumference of the inlet.

15. The spa apparatus of claim 14, wherein the fluid is in direct contact with a portion of the basin.

* * * * *